US007546795B1

(12) United States Patent
Munson, Jr.

(10) Patent No.: US 7,546,795 B1
(45) Date of Patent: Jun. 16, 2009

(54) ENHANCED LIGHT WEIGHT ARMOR SYSTEM WITH DEFLECTIVE OPERATION

(75) Inventor: David Murray Munson, Jr., Dallas, TX (US)

(73) Assignee: FOI Group, Inc., Dallas, TX (US)

( * ) Notice: Subject to any disclaimer, the term of this patent is extended or adjusted under 35 U.S.C. 154(b) by 612 days.

(21) Appl. No.: 11/153,301

(22) Filed: Jun. 15, 2005

Related U.S. Application Data

(60) Provisional application No. 60/579,982, filed on Jun. 15, 2004.

(51) Int. Cl.
*F41H 5/007* (2006.01)
*F41H 5/18* (2006.01)

(52) U.S. Cl. ..... 89/36.02; 89/36.03

(58) Field of Classification Search ..... 89/36.01, 89/36.02, 36.03, 36.04, 36.07, 36.08, 36.09, 89/36.12, 36.17; 428/188, 304.4, 313.3, 428/314.2, 321.5, 457, 911
See application file for complete search history.

(56) References Cited

U.S. PATENT DOCUMENTS

| | | | | | |
|---|---|---|---|---|---|
| 787,065 | A | * | 4/1905 | White | 114/12 |
| 2,376,331 | A | * | 5/1945 | Abrams | 89/36.08 |
| 4,045,027 | A | * | 8/1977 | Manska | 473/509 |
| 4,364,300 | A | | 12/1982 | Pagano et al. | |
| 4,426,429 | A | | 1/1984 | Di Russo et al. | |
| 4,512,585 | A | * | 4/1985 | Baravaglio | 273/410 |
| 4,613,535 | A | | 9/1986 | Harpell et al. | |
| 4,708,050 | A | * | 11/1987 | Hoskins | 89/36.04 |
| 4,732,803 | A | | 3/1988 | Smith, Jr. | |
| 4,836,084 | A | | 6/1989 | Vogelesang et al. | |
| 4,883,700 | A | | 11/1989 | Harpell et al. | |
| 4,979,425 | A | | 12/1990 | Sprague | |
| 5,149,910 | A | | 9/1992 | McKee | |
| 5,167,876 | A | | 12/1992 | Lem et al. | |
| 5,293,806 | A | | 3/1994 | Gonzalez | |
| 5,349,893 | A | * | 9/1994 | Dunn | 89/36.05 |
| 5,405,673 | A | * | 4/1995 | Seibert | 428/137 |
| 5,435,226 | A | * | 7/1995 | McQuilkin | 89/36.02 |
| 5,534,343 | A | * | 7/1996 | Landi et al. | 428/313.5 |
| 5,587,230 | A | | 12/1996 | Lin et al. | |
| 5,686,689 | A | | 11/1997 | Snedeker et al. | |
| 5,830,548 | A | * | 11/1998 | Andersen et al. | 428/36.4 |
| 6,004,424 | A | | 12/1999 | Cordova et al. | |
| 6,216,579 | B1 | | 4/2001 | Boos et al. | |
| 6,276,254 | B1 | | 8/2001 | Cordova et al. | |
| 6,357,332 | B1 | | 3/2002 | Vecchio | |
| 6,387,200 | B1 | * | 5/2002 | Ashmead et al. | 156/79 |
| 6,622,608 | B1 | | 9/2003 | Faul et al. | |
| 6,945,155 | B2 | | 9/2005 | Cordova et al. | |
| 2001/0012812 | A1 | * | 8/2001 | Spengler | 493/100 |

* cited by examiner

*Primary Examiner*—Bret Hayes
(74) *Attorney, Agent, or Firm*—D. Scott Hemingway; Hemingway & Hansen, LLP

(57) ABSTRACT

A light weight armor system for retrofitting onto a light vehicles or incorporating into a vehicle to protect against HEAT warheads. The armor system comprises an outer armor structure for rotating a HEAT warhead toward a preferred detonation angle to maximize the protection of underlying armor or vehicle structures. This first armor structure will further impart a rotational movement to increase the energy impact footprint, dissipate jet stream energy, and improve the probability that a second protection layer can successfully resist penetration by the jet stream. Coatings on the armor structure materials laterally impact a HEAT jet stream to further disrupt the jet and dissipate its energy.

25 Claims, 4 Drawing Sheets

ENHANCED LIGHT WEIGHT ARMOR SYSTEM WITH DEFLECTIVE OPERATION

RELATED APPLICATION DATA

This application is related to Provisional Patent Application Ser. No. 60/579,982 filed on Jun. 15, 2004, and priority is claimed for this earlier filing under 35 U.S.C. § 120. The Provisional Patent Application is also incorporated by reference into this utility patent application.

TECHNICAL FIELD OF THE INVENTION

A light weight armor system for protecting general purpose, support military vehicles.

BACKGROUND OF THE INVENTION

All combat combines both defense and offense. However the traditional battlefield has almost always had a safe rear area to provide for the fighting forces. Current weaponry and support vehicles have been designed following this age old pattern: The fighting equipment and men defend the support equipment and men. Armored vehicle technology has been exclusively the domain of the Armored Fighting Vehicle. Armored fighting vehicles (AFVs), both tanks and armored personnel carriers (APCs), first saw limited use in World War I. These early AFVs were little more than crude armor boxes built on caterpillar-tracked tractors. Both armor and weaponry have escalated dramatically since then.

In the early 1930s, shaped-charged warheads were developed that offered vastly superior armor penetrating performance coupled with ease of use and employment. The basic principle of the shaped-charge warhead is a concave or cone shaped hollow area in one end of the explosive core of the warhead. This hollow area is lined with a metal, typically copper. Upon detonation, the metal liner is compressed into a jet of very dense, superplastic metal moving at a speed of approximately 30,000 feet per second. While the actual material properties and physical behaviors are still not very well understood, the hypervelocity jet of metal can punch a hole in steel plate armor many times thicker than the diameter of the shaped-charge warhead.

Detonation distance is critical because the jet disintegrates and disperses after a relatively short distance (no more than 2 meters typically). The critical factor to the effectiveness of a shaped-charge, or high explosive anti-tank (HEAT), round is the diameter of the warhead. As the jet penetrates the armor, the width of the hole decreases leading to a characteristic "fist to finger" penetration effect. That is, the size of the eventual "finger" penetrating into the AFV depends on the size of the original "fist". In general, a HEAT round will penetrate armor thickness 150% to 250% of their diameter, although modern versions, such as the latest Russian RPG-7V, claim penetration ratios as high as 700% of the warhead diameter.

By the end of World War II, various anti-tank weapons had been developed and deployed that could be carried by one man to defeat AFVs, including hand-thrown grenades (e.g. Russian RPG-43) and warheads mounted on a rocket and launched from a rocket launcher (e.g. United States M7A1-"Bazooka"). Since World War II, HEAT rounds have become almost universal as the primary anti-vehicle weapon, because it can be used against all AFV and unarmored targets such as trucks and other general purpose vehicles or bunkers.

In modern warfare, man-portable anti-tank weapons represent one of the greatest threats on the battlefield. These weapons are relatively light, easy to transport, and can defeat most AFV armor if the AFV is struck in a vulnerable location. The Soviet RPG-7 is the probably the most ubiquitous of these weapons, because it has been produced by most Soviet client states including all of the former Warsaw Pact countries, Egypt, Libya, Iraq, Iran, China, North Korea, and numerous other countries, and it has been widely disseminated by these numerous producing countries. The RPG-7's maximum effective range against moving targets is 300 meters and the maximum range is 920 meters, and it can penetrate up to 600 millimeters (23 inches) of rolled homogeneous steel armor.

In the technology race of anti-tank weaponry versus armor protection, AFV armor protection technology has attempted to match increased lethality. Armor protection has improved dramatically and increasing use has been made of more unconventional means to increase protection. One of the unconventional modifications used in unconventional combat has been the use of standoff screens around a fighting vehicle to prevent shaped charges from detonating against the vehicle armor. Sand bags have also served as additional armor as have water cans.

While many armor advances have been proven effective and have been deployed on heavy AFVs, there has been virtually no effort to protect lighter non-combat vehicles such as trucks and the M998 HMMWV family of vehicles. While the M998 series has been modified with additional armor to increase protection against large caliber bullets and land mines, there has been little progress at protecting these rear echelon support vehicles from light anti-tank HEAT warheads, since it was believed that they were going to be protected by the fighting vehicles in the historic battlefield configuration The current situation faced by United States military forces in Iraq and Afghanistan has underscored the reality that rear echelon, support forces and their attendant vehicles are more likely, because of this vulnerability, to come under fire from light anti-tank weapons. Various irregular combatants are increasingly attacking support and rear echelon areas and bringing light vehicles under fire with RPGs and improvised munitions, such as artillery shells rigged as command-detonated mines. There is a need for a robust, light armor system that can be retrofitted on existing vehicles or be incorporated into new designs to provide effective HEAT warhead protection without a prohibitive weight penalty.

SUMMARY OF THE INVENTION

The invention is a lightweight armor system that prevents penetration of the passenger or cargo compartment of light vehicles by the jet from a HEAT warhead generated by light anti-tank weapons such as the RPG-7. The invention is contemplated as either an add-on, modular system that may be retrofitted on existing vehicles, incorporated as part of the structure of next generation vehicles, or mounted on buildings. It is further envisioned that this invention will be an outermost component of an additional armor layer.

No lightweight armor structure can protect using the same techniques as the heavy armored vehicles. Just as a man with a bamboo stick can deflect a sword if he hits it on the side, so can a lightweight flexible structure deflect the jet stream with forces perpendicular to its travel trajectory. The underlying concept of this armor design is to catch an RPG warhead in a rotatable deflecting container which either rotates and bounces back to throw the warhead away from the vehicle or rotates it to a preferred detonation angle relative to the protected area. An additional armor layer designed to disrupt and particulate the jet stream maximizes protection.

Shaped-charge jet streams are thin long irregular collections of metal and gas. Particulation, or the breakup of the stream into discrete particles, causes the velocity to drop very quickly as the surface area and frontal area goes up. This invention accelerates the breakup of the jet stream by several methods. The initial outer armor structure is designed to catch an in-flight warhead and either prevent detonation entirely by preventing the common nose fuse from impacting or rotationally aligning the warhead to deflect the jet stream from a near perpendicular path to a highly angled path directed against a light innermost armor layer. During this process, if the warhead detonates, the resulting jet stream initially impacts a mixture of materials inside of the rotating container just after the jet emerges from the warhead. These materials are designed to absorb heat and kinetic energy while imparting additional lateral loads on the jet stream and break down the coherency of the stream. Additionally, the materials are not uniform, but arranged and mixed so as to produce differential friction forces along with other steering forces. The components may include various lightweight gaseous containers to lower the density and also allow compressible material behavior.

The rotatable container's design reflects accelerated components back toward the jet and steer particles of the jet stream away from the protected area. The rotating container's design can withstand the energy of the warhead impact but not the detonation of the warhead, which produces far greater forces. The rotating container may be designed to break free of its axis after it has rotated sufficiently and be carried in a safe direction by the jet stream. Because it is not constrained and is light weight, it is subject to much lower penetration forces than a fixed material. Because its frontal area is several hundred times that of the jet stream, it causes a rapid deceleration. Because the material filling the container is heavier and unattached, it absorbs the initial impact and is both blasted away and left behind to impact other particles. The container may also be fitted with a weakened section that the jet stream will preferentially penetrate directing it to a safe discharge area. This discharge area can be toward below the vehicle, toward above the vehicle, or toward the front or rear of the vehicle, depending on the position of the container relative to the vehicle.

There are two or more components of the armor system. The first component is a system of interlocking rotatable container structures designed to catch an incoming HEAT warhead and rotate it relative to its movement path. The containers act to slow the warhead to the point that it will not possess sufficient energy to activate the fuse and detonate the warhead. As it rotates compression springs store energy for a rebounding action throwing the unfired warhead away from the vehicle before it self destructs. In this process, the containers align the warhead so that if it detonates, the jet stream will be unlikely to impact the additional layer(s) of armor or will strike an additional layer of armor or the vehicle's outer surface at an angle such that it does not penetrate through to the vehicle interior.

The optional next layer of the armor can be a composite foam matrix of the needed design thickness, which is embedded with angled vanes or plates to further deflect the jet stream. This armor layer overlays the innermost armor structure. The innermost layer is designed to absorb rotational energy by sliding friction and serve as a fail safe barrier to prevent penetration into the vehicle. This composite layer may serve both as primary structural member and an additional armor layer. This layer either serves as the attachment point on existing vehicles or the interior wall on new vehicles.

The system is envisioned to be constructed so that the outer sections can be field replaced to keep a vehicle in service.

BRIEF DESCRIPTION OF THE DRAWINGS

The objects and features of the invention will become more readily understood from the following detailed description and appended claims when read in conjunction with the accompanying drawings in which like numerals represent like elements and in which:

DETAILED DESCRIPTION OF THE PREFERRED EMBODIMENTS

One of the limitations of lightweight armor is that by its very nature it has a low capacity to absorb and dissipate large amounts of heat and kinetic energy. Shaped-charge weapons produce both high heat and high kinetic energy. As the charge slides along or penetrates the armor some of the kinetic energy is converted into heat melting or vaporizing the impacted armor materials. It is preferable to deflect the jet stream rather than attempt to stop it. Current ceramic armor systems that are most effective utilize sloped plates to accomplish this. Ceramics can withstand the high energy loads, but they are heavy and brittle.

Figure 1:
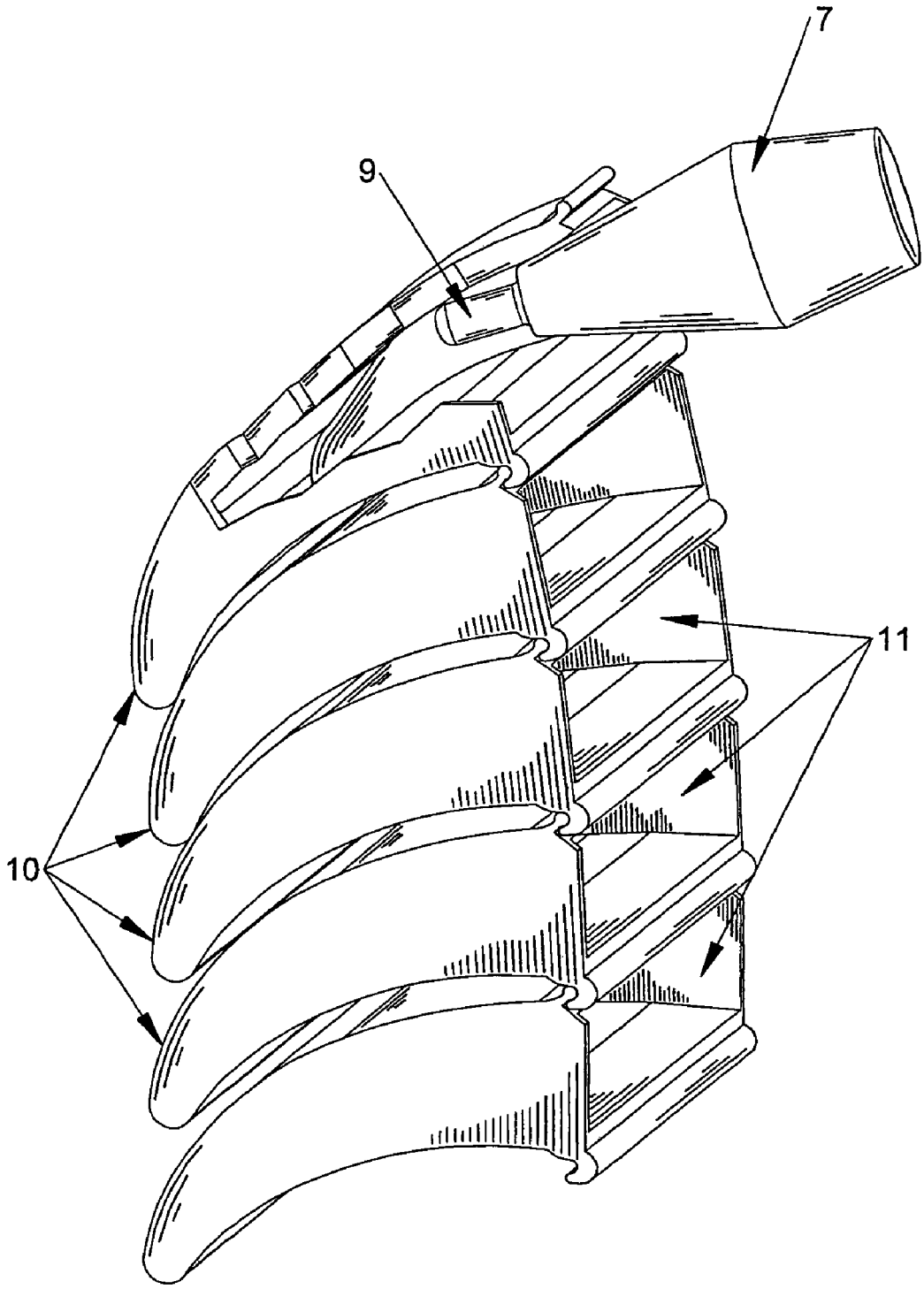
FIG. 1 shows a schematic side view of the armor showing the first, outer armor system layer.

The invention utilizes a complementary doubled-layer armor system to protect a vehicle from a HEAT warhead. Referring to FIG. 1, the first component of the armor system is the outer section of hinged, interlocked rotatable containers 10. The containers are designed to minimize the possibility of the warhead fuse 9 detonating or the jet penetrating into the vehicle by either slowing the warhead 7 to the point that it will not detonate and be deflected away or align at an angle before detonation that allows an inner-most protection layer to fully defeat the jet stream. These containers 10 are configured to have a rectangular outer opening 11 sized to catch the most commonly used rocket propelled grenades (RPG) warheads 7 by the front sloped outer case with a probability of preventing triggering of the nose mounted fuse 9. This opening 11 is designed to cause the projectile to rotate away from a vehicle before impacting a surface with sufficient energy and at an angle to activate the impact fuse 9. Thus, if detonation occurs, the jet stream will be angled away from the vehicle.

Figure 2:
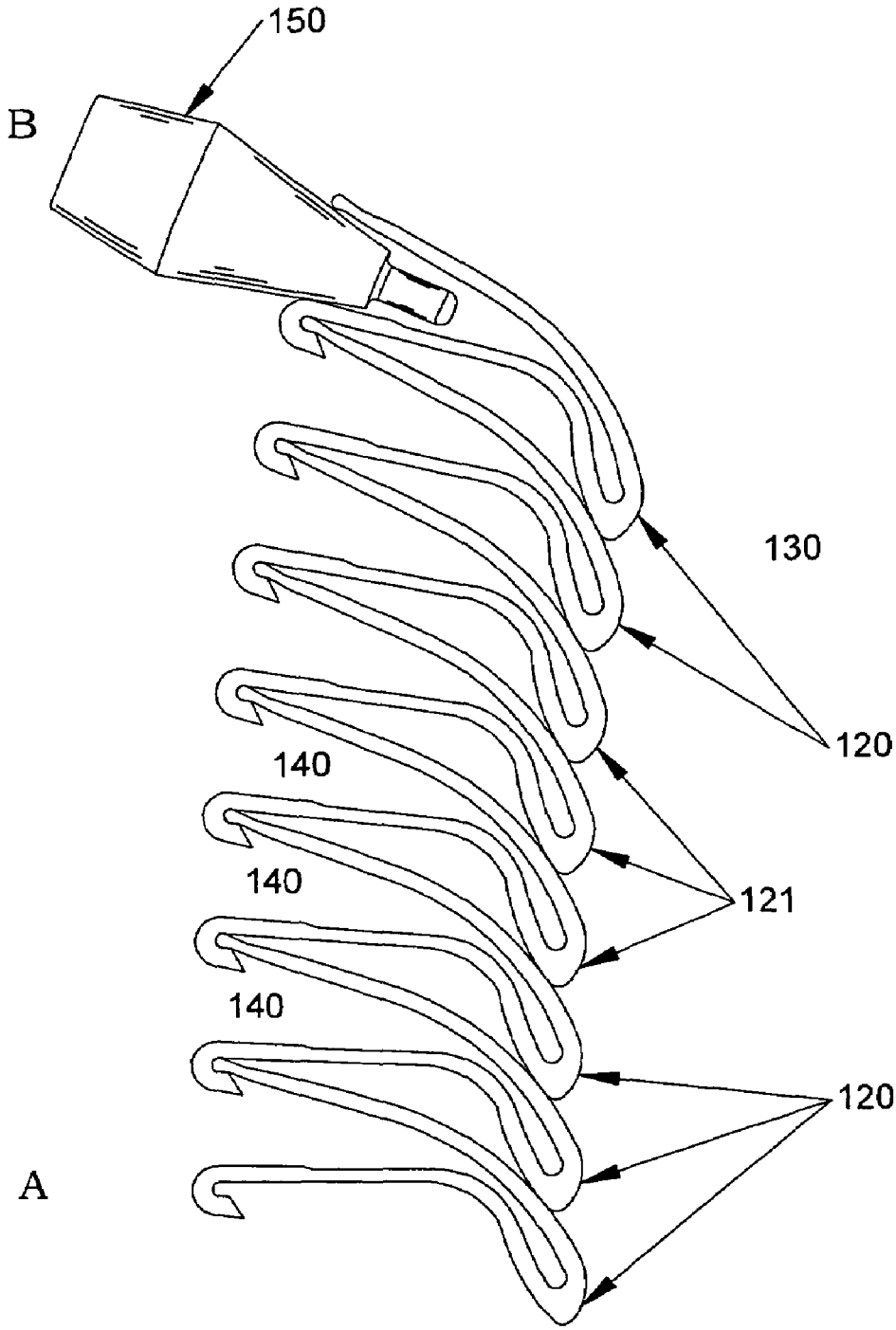
FIG. 2 shows more details of the rotation of outer layer of armor.

An additional design feature of this container section is to create a weakened area which when breached directs the jet further away from the vehicles protected areas. Referring to FIG. 2, the RPG's impact with a near perpendicular alignment at point A causes the container section 120 to start rotating downward end-over-end to position B at a sharply increased angle. The RPG 150 is caught usually without detonation at position A. The container 120 initially rotates alone, but subsequently, because of the interlocking design, with some of its attached neighbors to a stopped position B such that the RPG 150 is sharply angled relative to the protected area 130 and positioned so if detonated the jet stream is directed toward the ground at a highly oblique angle relative to the protected surface. The inner portion 121 of the container 120 slides along the innermost wall of the system so that sliding friction additionally aids slowing the RPG 150 to maximize the chance that the fuse will fail to detonate. The force required to rotate the container 120 should be below the energy of a bullet which could penetrate the combined components of the outer container layer of the system. In this way, bullets or small cannon projectiles which could penetrate the static defenses could be deflected by rotation, while bullets which could not penetrate would not rotate the panels.

The rotation provides a much greater effective strength to the section as only the energy used to accelerate the containing structure is transferred to it. The fixed components of the section very quickly accelerate to rotate rapidly upon impact of the warhead. If the RPG 150 detonates before rotation finishes, the jet will further accelerate the container 120 and contain the jet's kinetic and heat energy load within the larger volume of the containing structure. The container 120 has a larger frontal area, effectively increasing the protection to inner armor layers and hopefully imparting sufficient centrifugal rotational forces on the jet to disrupt its coherency and lessen the amount of kinetic energy delivered against the inner armor layers.

The goal of this outer layer of the armor system is not stop the RPG 150, but to contain it momentarily within a moving structure until safe release of the jet stream can occur. Preferably, if detonation occurs, the goal is to have it occur after rotation has finished with the jet stream not hitting the inner layers or at such an advantageous angle as to maximize an inner armor layer's protection. Detonation occurring with such high imparted centrifugal force is likely to further disrupt the jet or laterally distribute its energy load against an inner armor layer.

Figure 3:
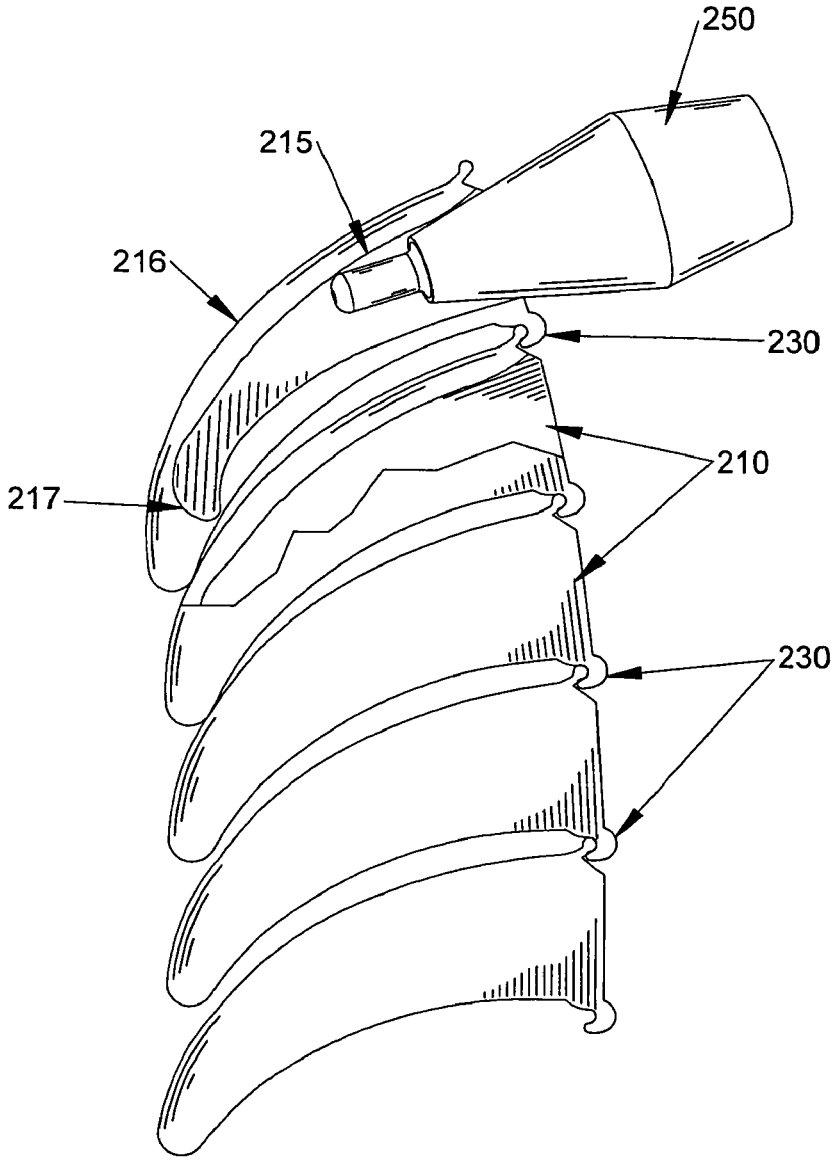
FIG. 3 shows more details for the outer and inner layer of armor.

The interior 140 of the container 120 has multiple critical functions that act to deflect jet streams and other projectiles away from protected areas by both active and passive means. It slows all projectiles and stops rounds of insufficient energy to rotate the section. FIG. 3 shows additional details on the composition of the interlocking containers 230. The outermost hollow portion 210 has a depth sufficient to stop a RPG 250 by its outer case without an impact to the fuse. Immediately inward from this area is a parabolic composite lining 215 wherein the nose section of RPG 250 (and its associated fuse) fits into the vertex of the parabola 217. The container lining 215 consists of an outermost dimpled very thin skin of aluminum, steel, plastic, Teflon™, composite, or other similar material sealing a layer of water against an outermost composite. The entire container 230 is encircled by a layer of water contained within a double-wall construction formed by the outer composite structure 216 and the inner container lining 215. The outer composite structure 216 forms a roughly parabolic curving container, approximating the curving parabolic construction of the inner lining 215.

The interlocking container 230 is aligned so that the warhead will strike the lining 215 at an oblique angle that fails to detonate the fuse and imparts rotational movement of the container 230. The vertex of the parabola 217 is designed to have non-uniform strength so when penetrated it pushes the RPG 250 further away from the protected area but is sufficiently durable to survive until the embedded water layer is superheated by a detonating RPG 250. Because the container sections 230 are elongated, this water layer is intended to cool the initial superheated air in front of a RPG blast and create a much higher density atmosphere for the metal jet to travel through. The water layer within the lining 215 can be designed disproportionately on the side of the inner lining 215 away from the desired exit trajectory. The triggered steam explosion from the lining 215 and the vertex of the parabola 217 generated by the heat and kinetic energy applies a lateral force on the metal jet causing particulation and deflection. Select structural parts of the containers 230 are also designed to fail to further control and deflect the path of the jet stream.

The vertex of the parabola 217 can include a variety of materials that are ejected or left behind when the jet stream hits. These could include heat absorbing compounds such as potassium bicarbonate (e.g. Purple K) enclosed in lightweight plastic or composite foams, thin metal films or sheets, water bubbles, carbon filaments, or other similar materials designed to both cool and particulate the jet stream. Most of these materials would not accelerate uniformly with the section but provide substantial damping directly and indirectly to the speed of the metal stream. The lining 215 can be flexible and elastic enough to allow the container 230 to rotate while initially leaving structural elements in place for a few milliseconds. As it nears the end of its rotations these structural elements rebound, helping to slow the container 230 at the end of its rotation. It may be desirable to have a gradual controlled stop to prevent a premature rupture of the section or additional damage to the adjoining sections of armor, but it is more important to initiate rotating the RPG 250 end-over-end to a highly angled alignment relative to the inner vehicle structure or armor layers before the nose fuse is crushed to initiate detonation.

When fully rotated, the jet stream from a RPG 250 detonating is directed toward a desired angle to exit from the outer armor section. Alternatively, the container section 230 can be designed to break free after rotation and detonation and travel with the jet stream or large caliber round minimizing other damage. The rotation mechanism may also incorporate a spring back or ejection function to expel an undetonated RPG 250 before it self-destructs.

Alternatively, rather than parabolic containers, the outer layer can be composed of an array of cone-like structures with a similar cross-section as found in FIG. 3. These cone structures would be mounted so as to rotate and align a warhead in a similar fashion as described above. The cones would also be lined with the identical materials and function primarily to rotate the warhead toward a preferred detonation angle.

Figure 4:
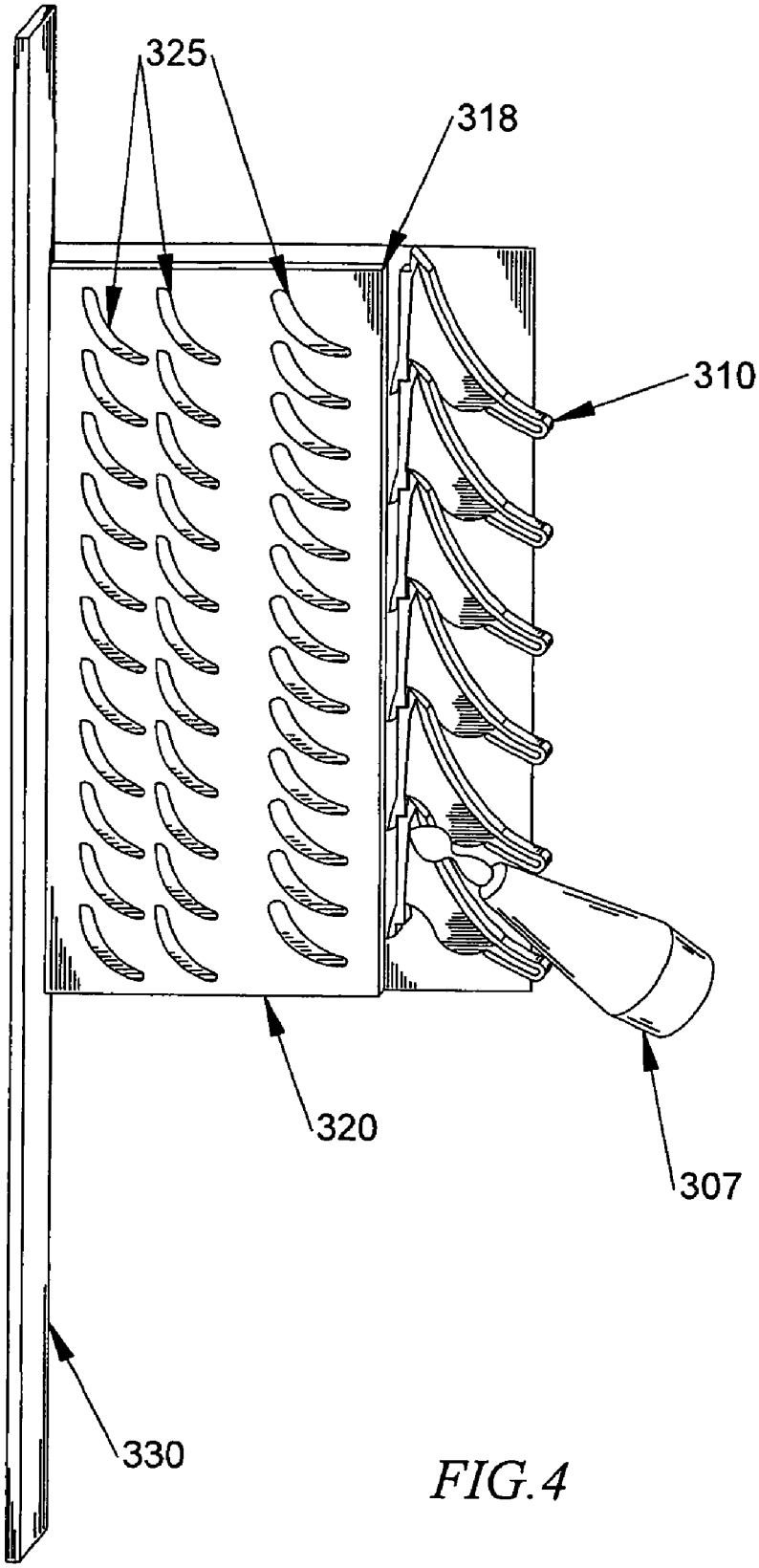
FIG. 4 shows a schematic side view of both the first and the second armor structures.

Referring to FIG. 4, the next layer of this armor system is a composite block matrix 320 imbedded with multiple rows of angled metal or ceramic vanes or plates 325. These angled vanes 325 have a low friction outward deflecting surface and an interior surface and construction to induce friction and resistance to the inside of a deflecting path. This may include a variety of components such as a layer of Purple K powder overlaying a layer of plastic film, hook like protrusion, lightly attached small adhesive bodies, and other design components. The outward facing layer on the vanes 325 further includes a matrix of cells filled with a water/anti-freeze mixture covered by a light metal or Teflon™ film. A jet from a RPG 307 will superheat the vanes 325 to create a blast of high pressure steam into the jet to disrupt the jet of superplastic metal and create a high pressure steam cushion for the jet stream particles to slide on. This increases the durability of the vanes 325. It is also contemplated that the vanes 325 are placed so as to make incoming particles both slide on the low friction surface on one vane 325 and be slowed by the arrangements of ensnaring and decelerating friction components on the inner side of the outwardly adjacent vanes 325. The composite block matrix 320 further includes imbedded Purple K and/or cells filled with water/anti-freeze mixture that further cool and disrupt the jet.

It is envisioned that the outer armor containers 310 will align the RPG 307 to detonate at a relative angle of greater than 60 degrees to the composite matrix block armor surface 318 or surface of the vehicle. It is further envisioned that the composite matrix block 320 will contain at least three layers of vanes 325. When the RPG 307 detonates, the metal jet stream impacts against the composite matrix block 320 and is coated with Purple K and impacted by high pressure steam found within the matrix block 320. The matrix block 320 may be composed of a material that vaporizes to create high pressure gas that back blast against the stream. These complimentary forces of high pressure steam, high pressure gas, and propelled Purple K act to particulate and cool the jet and dissipate its energy. It is further envisioned that at the time of detonation, the HEAT round 307 will be under high g-force loads because of end-over-end rotation imparted by the angled containers 310 so that vertical or lateral movement of the jet stream will further scatter its energy footprint to diminish its armor penetration potential.

Additionally, the angled vanes 325 act to further channel the jet at an angle to dissipate and channel the energy. The water cells on the vanes 320 also vaporize to create high pressure steam to force Purple K laterally into the jet and further cool and disrupt the jet. To increase the lateral disruption, only the upper level of the vanes 325 may be coated to produce a unidirectional lateral force loading from steam pressure and propelled Purple K. If the jet strikes the inner armor vehicle structure 330, its path has been channeled to impact the vehicle 330 at an angle that offers a high probability that this final protection layer can defeat the jet. At that point, the jet has been diverted, cooled, and particulated to a point where the inner vehicle structure 330 can not be penetrated by the diverted, weakened jet.

While the invention has been particularly shown and described with respect to preferred embodiments, it will be readily understood that minor changes in the details of the invention may be made without departing from the spirit of the invention. Having described the invention,

I claim:

1. A light composite armor system for vehicles or buildings comprising:

a plurality of hollow containers arranged in an interlocking matrix so as to each align to deflect a warhead toward a preferred detonation angle relative to the surface of the vehicle or building, said hollow containers rotating said warhead to said preferred detonation angle; and, a coating on said plurality of hollow containers that exerts a lateral force on a detonated high explosive warhead jet stream, said coating positioned on a portion of the hollow container and enclosing potassium bicarbonate powder or water so as to exert said lateral force on the jet stream of said warhead.

2. The light composite armor system for vehicles or buildings of claim 1 wherein each container is configured with an outer opening sized to catch a rocket propelled warhead.

3. The light composite armor system for vehicles or buildings of claim 2 wherein each container is sized to not impact a warhead's fuse at the vertex of a parabola or a cone structure formed by the hollow container.

4. The light composite armor system for vehicles or buildings of claim 1 wherein the preferred detonation angle is at least sixty degrees relative to the vehicle or building surface.

5. The light composite armor system for vehicles or buildings of claim 1 wherein each container is constructed with a parabolic curving inner lining composed of a thin skin of material sealing a layer of water against an outer structure.

6. The light composite armor system for vehicles or buildings of claim 5 wherein the thin skin consist of at least one of the following:

aluminum;
steel;
plastic;
TEFLON™; or
a composite.

7. The light composite armor system for vehicles or buildings of claim 5 wherein each container is aligned within the matrix and sized to deflect a warhead at an oblique angle toward a vertex of the parabolic lining to minimize chances of detonating a fuse.

8. The light composite armor system for vehicles or buildings of claim 5 wherein the area between the lining and the outer surface at the vertex of the parabolic lining includes at least one of the following:

potassium bicarbonate;
plastic foam;
composite foam;
metal film;
metal sheet;
water bubbles; or
carbon filaments.

9. The light composite armor system for vehicles or buildings of claim 1 further comprising:

a second armor layer attached to the vehicle or building comprised of a composite matrix block embedded with multiple rows of angled vanes, said vanes covered with a matrix of water-filled cells on one side oriented to face outward from the vehicle or building; and potassium bicarbonate embedded within the composite matrix block.

10. The light composite armor system for vehicles or buildings of claim 9 further comprising a layer of potassium bicarbonate powder and a layer of plastic film on the side of the angled vanes facing toward the vehicle or building.

11. The light composite armor system for vehicles or buildings of claim 9 wherein there are at least three rows of overlapping angled vanes.

12. A method for armoring vehicles or buildings comprising the steps of:

providing a first armor structure composed of a plurality of first armor components that catch and rotate an anti-tank warhead to a preferred angle relative to a second armor structure;

constructing each of said first armor component as a double-walled container with a parabolic curving inner liner and an exterior interlocking container, said double-walled component including a layer of water and potassium bicarbonate powder between the inner liner and the exterior interlocking container;

forming said curving inner liner to form a vertex at the base of the liner, said vertex sized for a fused warhead to fit into without said fuse contacting said base; and mounting said first armor component at an angle on the first armor structure relative to the second structure.

13. The method for armoring vehicles or buildings of claim 12 further comprising the steps of attaching the second armor structure to the vehicle or building composed of a composite matrix block embedded with multiple rows of angled vanes, angled with a first side facing outward and a second side facing inward;

covering each of the vanes with a matrix of water-filled cells on the first side facing outward; and embedding potassium bicarbonate within the composite matrix.

14. The method for armoring vehicles or buildings of claim 13 further comprising the step of:

coating the vanes with a layer of potassium bicarbonate powder and a layer of plastic on the second side facing inward.

15. The method for armoring vehicles or buildings of claim 13 further comprising the step of:

providing at least three rows of overlapping angled vanes.

16. The method for armoring vehicles or buildings of claim 12 wherein the inner liner is made from at least one of the following:

aluminum;

steel;

plastic;

TEFLON™; or a composite.

17. The method for armoring vehicles or buildings of claim 12 wherein the double-wall area at the apex includes a layer of material composed of at least two of the following:

potassium bicarbonate;

plastic foam;

composite foam;

metal film;

metal sheet;

water bubbles; or carbon filaments.

18. The method for armoring vehicles or buildings of claim 12 wherein the preferred angle is at least sixty degrees relative to the second armor structure.

19. A method for protecting against a shaped-charged warhead comprising:

rotating the warhead toward a preferred detonation angle relative to a vehicle using a first armor structure;

impacting a jet stream from a detonating warhead laterally with potassium bicarbonate powder originating from an armor component;

impacting a jet stream from an anti-tank warhead laterally with steam originating from an armor component; and deflecting a jet stream using a second armor structure.

20. The method for protecting against a shaped-charge warhead of claim 19 further comprising the steps of:

constructing the first armor structure of a plurality of first armor components operating to rotate the anti-tank warhead to the preferred detonation angle relative to the second armor structure; and mounting said first armor component at an angle on the first armor structure relative to the second structure.

21. The method for protecting against a shaped-charge warhead of claim 19 wherein the preferred detonation angle is at least sixty degrees.

22. The method for protecting against a shaped-charge warhead of claim 19 further comprising the step of:

constructing each of said first armor component as a double-walled container with a parabolic curving inner liner and an exterior interlocking container, said double-walled component including a layer of water and potassium bicarbonate powder between the inner liner and the exterior interlocking container.

23. The method for protecting against a shaped-charge warhead of claim 19 further comprising the step of:

constructing a second armor structure of composite matrix embedded with multiple rows of angled vanes having a first side facing outward toward the first armor structure and a second side facing inward.

24. The method for protecting against a shaped-charge warhead of claim 23 further comprising the steps of:

coating each of the vanes with a matrix of water-filled cells on the first side facing outward; and embedding potassium bicarbonate within the composite matrix.

25. The method for protecting against a shaped-charge warhead of claim 23 further comprising the steps of:

coating each of the vanes with a layer of potassium bicarbonate powder and a layer of plastic on the second side facing inward; and embedding potassium bicarbonate within the composite matrix.

* * * * *